US005092082A

United States Patent [19]

Padberg et al.

[11] Patent Number: 5,092,082

[45] Date of Patent: Mar. 3, 1992

[54] APPARATUS AND METHOD FOR LAMINATED GRINDING DISKS EMPLOYING VIBRATION DAMPING MATERIALS

[75] Inventors: Hans J. Padberg, Bonn; Josef Keuler, Ramersbach; Henning Brandin, Bad Honnef; Klaus H. Thormeier, Odenthal, all of Fed. Rep. of Germany

[73] Assignee: Feldmuehle Aktiengesellschaft, Duesseldorf, Fed. Rep. of Germany

[21] Appl. No.: 940,062

[22] Filed: Dec. 10, 1986

[30] Foreign Application Priority Data

Dec. 20, 1985 [DE] Fed. Rep. of Germany ..... 3545308

[51] Int. Cl.[5] ..... B24D 3/28; B24D 3/34

[52] U.S. Cl. ..... 51/207; 51/401; 51/297; 51/298; 51/295

[58] Field of Search ..... 51/207, 400, 401, 402, 51/293, 297, 298, 295

[56] References Cited

U.S. PATENT DOCUMENTS

| | | | |
|---|---|---|---|
| 2,733,987 | 2/1956 | Gartrell | 51/298 |
| 3,631,638 | 1/1972 | Yoshikawa | 51/297 |
| 4,062,153 | 12/1977 | Malm | 51/297 |
| 4,615,151 | 10/1986 | Huber et al. | 51/293 |

FOREIGN PATENT DOCUMENTS

| | | | |
|---|---|---|---|
| 329100 | 4/1985 | Austria . | |
| 2632652 | 2/1977 | Fed. Rep. of Germany . | |
| 2610580 | 9/1977 | Fed. Rep. of Germany . | |
| 2825576 | 12/1979 | Fed. Rep. of Germany . | |
| 0031520 | 3/1980 | Japan | 51/293 |

*Primary Examiner*—Robert A. Rose
*Attorney, Agent, or Firm*—Felfe & Lynch

[57] ABSTRACT

Laminated grinding disks are built up in layers with the interposition of at least one layer of vibration-damping materials as sound insulation, the layer of vibration-damping materials being placed in the mold in the form of fine, free-flowing powder and/or granules. The powder or granules can consist of elastomers which can withstand heating to more than 110° C. The elastomer can be mixed with synthetic resin. The addition of filler improves the working qualities of the mixture and improves its granulability.

32 Claims, 3 Drawing Sheets

Fig. 1
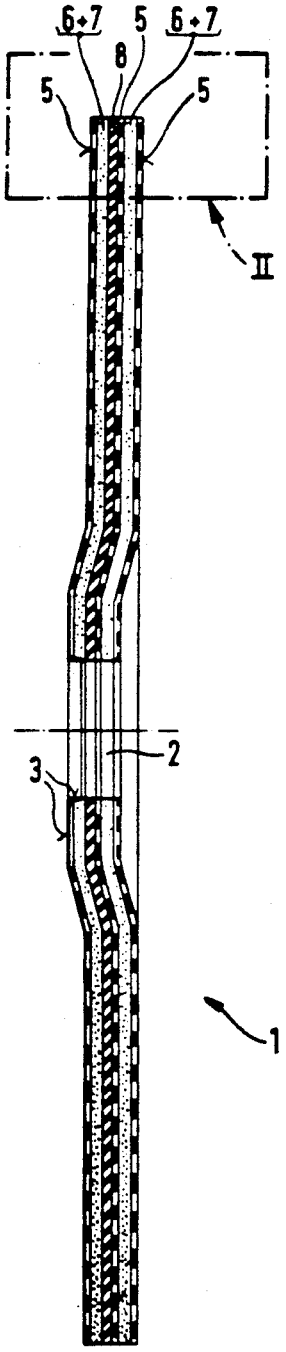
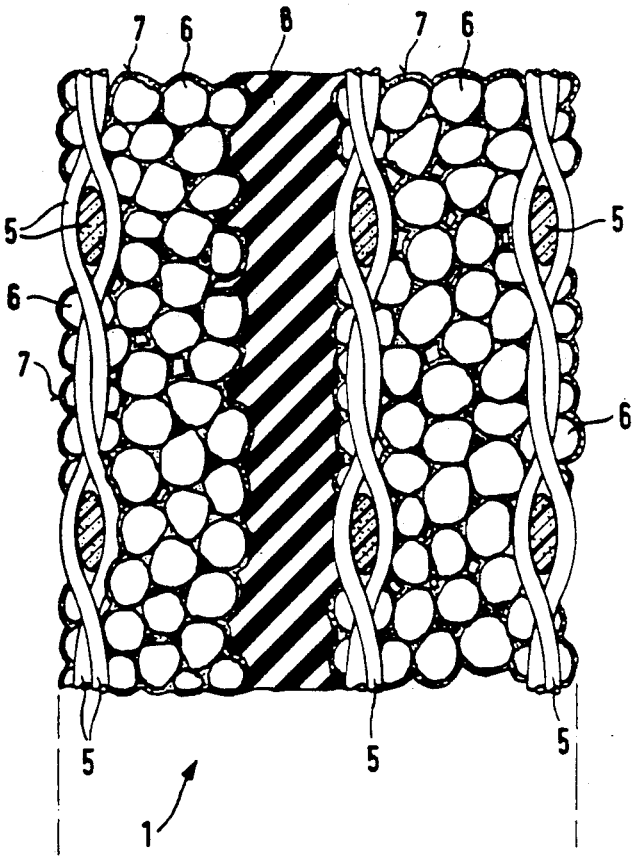
Fig. 2

Fig. 3
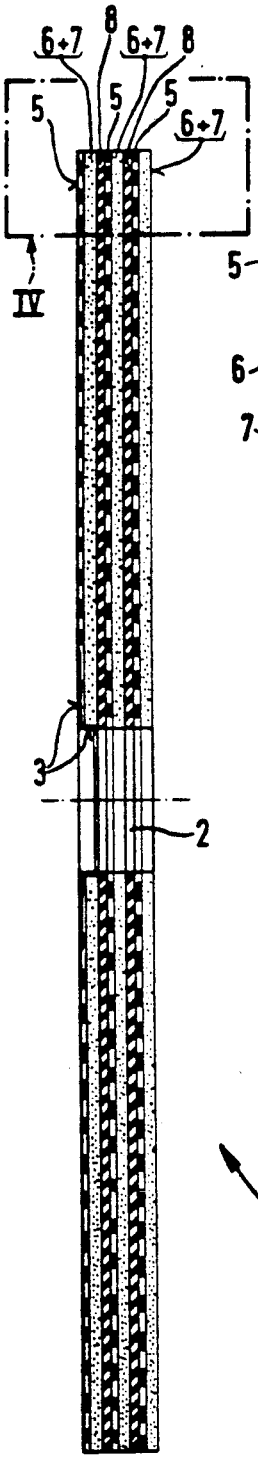
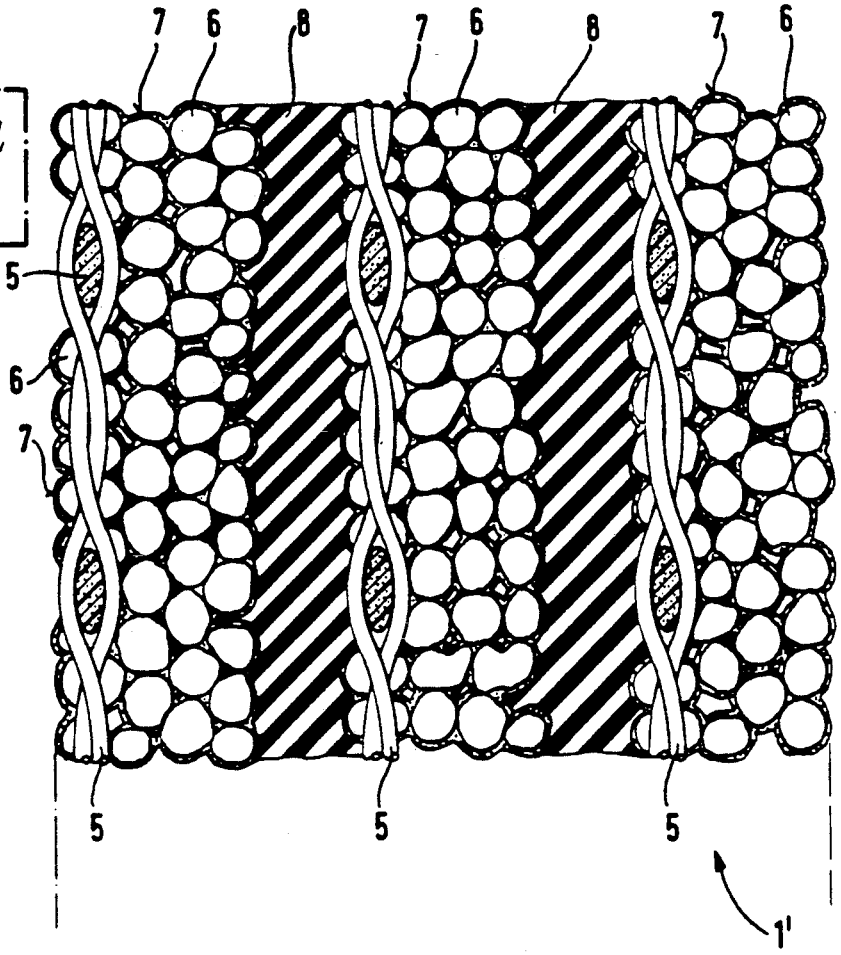
Fig. 4

Fig. 5
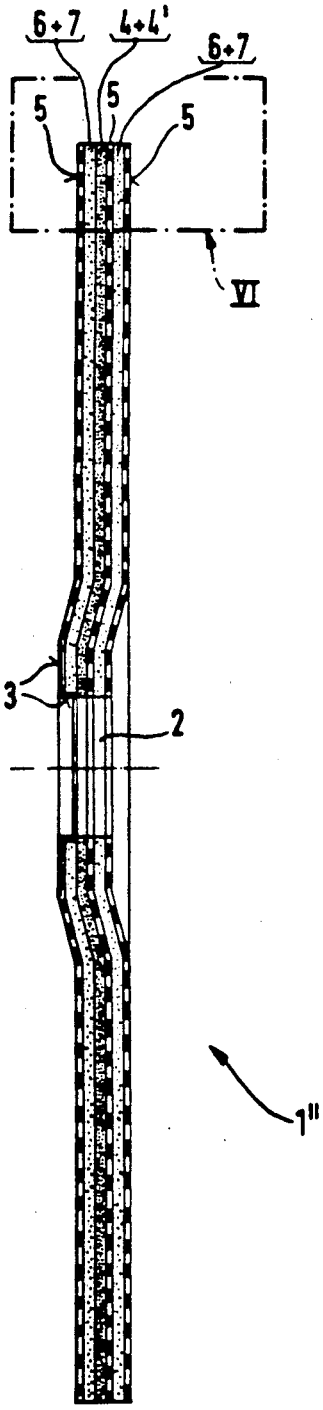
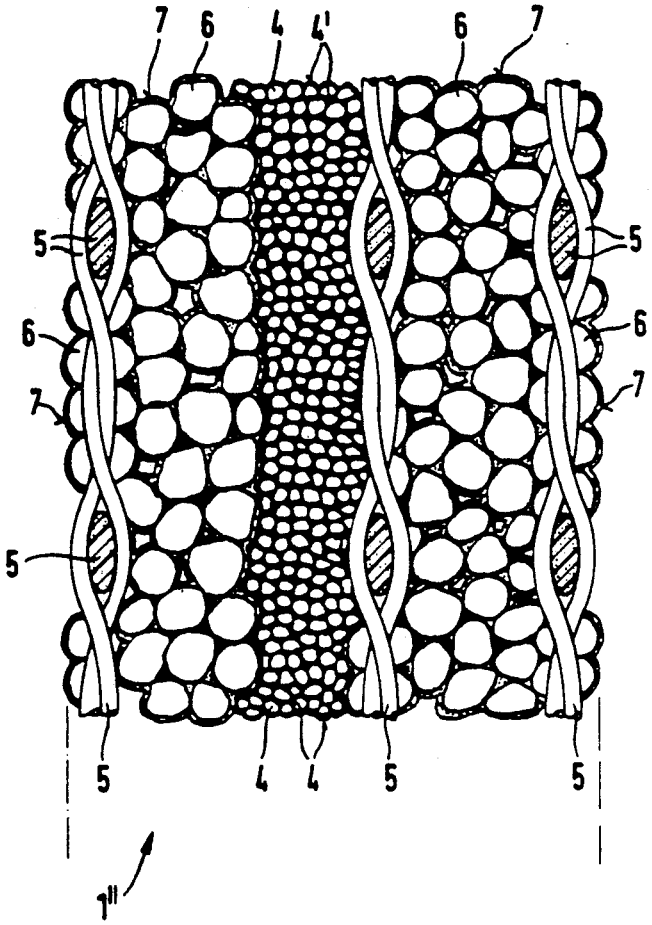
Fig. 6

APPARATUS AND METHOD FOR LAMINATED GRINDING DISKS EMPLOYING VIBRATION DAMPING MATERIALS

BACKGROUND OF THE INVENTION

The invention relates to a method for the manufacture of laminated grinding disks, especially laminated cut-off and rough-grinding disks for free-hand grinding, in which mixtures of grinding grits and binding agents, as well as fillers in some cases and reinforcements in some cases, are placed in a mold in layers with the interposition of at least one layer of vibration damping materials, and are pressed to form a sandwich and the sandwich is cured.

In grinding and cut-off work, but especially free-hand grinding, vibrations develop which create a considerable amount of noise, and these vibrations occur both on the workpiece and on the grinding machine and on the grinding disk itself. Although it is possible in the case of stationary machines to damp these vibrations at least partially, or to place the machine itself in an enclosure and thus reduce the noise to the benefit of the operating personnel, this possibility does not exist in the case of hand grinding work in which cut-off or roughing disks generally known as flex disks, are used. In line with the progress of environmental awareness, therefore, there is a considerable need for grinding disks which produce less noise when used. Grinding disks which, on the basis of their construction, have less tendency to produce vibrations are known as noise-damped grinding disks, and are disclosed in this form in DE-OS 26 10 580, DE-OS 26 32 652, and AT-AS 46 15/82. All these proposals have in common that, between the actual grinding layers, noise damping layers are disposed, which can consist of a polymer or a vibrationdamping film, e.g., nitrile rubber.

The methods of manufacturing these known grinding disks, however, are very complex. For example, it is stated in DE-OS 26 32 652 that two finished, so-called "grinding plates" having a certain diameter-to-thickness ratio, are bound together by a polymer layer which is at least 0.2 mm thick and has at most the thickness of the "grinding plates." The polymer, which can be an adhesive, is applied in a paste or in a liquid or molten state between the two "grinding plates" and then dried, hardened or solidified, in order thus to bind the two "grinding plates" tightly together. A thermoplastic resin can be used as the polymer, but preferably plastics which can be set by heat treatment are used.

The method is very complex, because in this method at first finished "grinding plates" have to be made in order to be joined together afterward.

DE-OS 26 10 580 also discloses a device having a plurality of thin grinding disks forming the layers of abrasive material are coated with a binding agent, placed one on the other, and compressed. To achieve greater thicknesses in the damping layers, disks of thermoplastic film and disks of abrasive material can be layered alternately one on the other and pressed together with heat so that the thermoplastic material is bonded to the disks of abrasive material.

In contrast to the two disclosures discussed above, which set out from an already finished "grinding plate," AT-AS 46 15/82 provides that a vibration-damping film of, for example, nitrile rubber is placed on a grinding grit mixture in a press and pressed together with the mass of grinding grits. The grinding disk sandwich thus produced is clamped between pack plates and hardened in the oven. Due to the fact that, in each case, a film of nitrile rubber has to be stamped out to fit the mold, or this film has to be first duplexed onto the fabric and then laid in the press together with the latter, and after it is pressed the grinding disk sandwich has to be clamped between pack plates and cured in the oven, the process is decidedly time-consuming and hence involves high labor costs.

It is furthermore disadvantageous that the sandwich always springs back up slightly after pressure, which is attributed to the elasticity of the vibration damping film. This degrades the bond to the adjacent grit layers, so that the danger exists that some areas of the grinding grit layers will not be in contact with the film layer and thus no bond will be formed.

The present invention is therefore addressed to the problem of devising a method which will assure perfect adhesion between the abrasive material and the noise-damping material over the entire area of the layer, and in which this sound-damping layer can be applied quickly and simply.

SUMMARY OF THE INVENTION

This problem is solved by a method for the manufacture of laminated grinding disks, especially cut-off and roughing disks for free-hand grinding, in which mixtures of abrasive grit, binding agents, and, in some cases, fillers and in some cases reinforcements, are placed in layers in a mold with the interposition of at least one layer of vibration damping materials, pressed to form a sandwich, and the sandwich obtained is cured, with the distinctive feature that the layer or layers of vibration damping material are placed in the mold in the form of fine, free-flowing granules or powder.

Inasmuch as the vibration damping material is used in powder or granular form and is still finely granular, the applied layer automatically adapts itself to the surface structure of the previous layer and the next layer, i.e., no voids are formed between the individual layers after they have been pressed. The powder or granules furthermore assure that no undesirable spring-back will occur after the pressing of the grinding disk, because the reinforcing, or any areas of the abrasive grit that protrude from the grit layer, become automatically embedded in the layer of vibration damping material and thus cannot be urged against a solid surface resulting in spring-back.

Since the sandwich does not spring back, it is not necessary to either keep the disks or cure them in the oven under constant pressure. The advantage over the known state of the art lies therefore not only in the possibility of putting the material in powder or granular form more rapidly into the conventional presses such as have long been used in the manufacture of grinding disks, but also in the fact that after the pressing no additional work is necessary.

An advantageous embodiment of the invention provides for the charging of at least one elastomer in powder or granular form which withstands a temperature of more than 110° C.

Such elastomers include, in addition to a wide variety of natural and synthetic rubbers, butyl rubber, nitrile rubber in the form for example of Perbunan N, neoprenes, fluoroelastomers, polyacrylate, polyurethanes, silicone rubber, polysulfite rubber and Hypalon. All of these elastomers must be more or less modified in order to withstand the thermal stress but nevertheless have the elasticity that is required for the reduction of noise.

The testing of various noise-damping coating materials has shown that the upsetting of cylindrical models under defined conditions, i.e., stress 5 kp, dimensions: diameter 15 mm, height = 20 mm, provides a good indication of how noise will be reduced in the later grinding process. The noise damping increases with elasticity. At the same time, however, the workability of the damping layer mixture as well a strength in the noise-reducing grinding disk is impaired. As it can be seen in Table 1, the best results as regards noise level are obtained with a percentage of upset between 4.2 and 18.4%. When the upset was more than 24%, the damping layer mixture was difficult to work, and the loss of strength in the finished noise-reducing grinding disk was so great that it could no longer be used.

TABLE 1

| Upset and Noise Level | | |
|---|---|---|
| Upset (%) | Noise level (dBA) | Remarks |
| 1.7 | 76 | Easily worked, no loss of strength |
| 4.2 | 73 | |
| 12.9 | 70 | |
| 18.4 | 67 | |
| >24.0 | — | Can no longer be worked; loses strength |

Another advantageous possibility is to use as the powder or granular material a mixture of one or more synthetic resins and one or more elastomers. The use of a synthetic resin in combination with the rubber results in a better bond between the noise-damping layer and the grinding grit which itself is also bonded with synthetic resin. The choice of the synthetic resin will depend first of all on heat resistance, but secondly on compatibility with the rubber and the synthetic resin that is used as binding agent for the grinding grits in the construction of the grinding disk. When phenol-formaldehyde resins commonly used in the production of resin-bonded abrasive tools are employed, a phenol-formaldehyde resin can also be used as synthetic resin for the noise-damping layer. The use of other thermosets, such as melamine resin, urea resins and polyester resins, for example, is also conceivable.

Particularly suitable on account of its high strength and good bonding to the phenolic resins and the rubber is epoxy resin.

A preferred embodiment of the invention provides for mixing an epoxy resin with a nitrile rubber in the quantity ratio of 10:90 to 70:30.

As the epoxy resin content increases the sound damping decreases and the strength of the noise-damped grinding disk increases. The optimum range for noise damping and grinding power is to be found in the addition of 15 to 25% of epoxy resin to the nitrile rubber.

The treatment of the noise-damping material constitutes a special difficulty in the production of noise-damped grinding disks. More or less all of the usable materials are sticky and therefore are not free-flowing. "Stickiness" is to be understood to mean that the particles cling together to form larger agglomerates, i.e., the material is of an irregular consistency, and clumps form which result in irregular distribution in the pressing operation. The finished grinding disk thus also becomes inhomogeneous. Also, the material sticks to the sliders in the press.

Special importance, therefore, is to be attributed to the embodiment of the invention which provides for the mixture to be rendered uniform by the addition of a filler.

The homogeneous mixture thus obtained is non-sticky and thus easy to place in the mold. The danger, however, exists that mixtures of fine powder, especially, raise dust. An advantageous embodiment of the invention therefore provides for the mixture to be brought, with the addition of filler, to a grain size of 50 to 2,000 microns in a granulator.

The addition of filler simplifies granulation, and at the same time reduces stickiness to such an extent that free-flowing granules result. The granule size is important on the one hand to free flowing, and on the other hand it is a requirement which varies with the size of the grits required by the grinding disk. So it is desirable to use finer granules than the grit size of the grinding disk, in order to achieve the densest possible packing and thus a good bond between the grits and the noise-damping layer.

According to a preferred embodiment of the invention, up to 5% of inorganic filler, such as MgO, ZnO, talc or marble flour will be added to the mixture. All these fillers considerably reduce stickiness without thereby interfering with the reactions that occur when the grinding disk is cured.

Another advantageous embodiment of the invention provides for the use of a mixture of cork flour and synthetic resin as the powder or granular product. The cork flour in this case can best have a grain size that is between 50 and 1,000 microns; the synthetic resin can best be epoxy resin.

BRIEF DESCRIPTION OF THE DRAWING

The invention will be described below in reference to the drawings.

FIG. 1 is a side elevational view of a recessed-center rough-grinding flex disk in cross section, FIG. 2 is an enlarged detail of area II of FIG. 1, FIG. 3 is a side elevational view of a straight rough-grinding flex disk in cross section, which has two damping layers, FIG. 4 is an enlarged detail area IV of FIG. 3, FIG. 5 is a side elevational view of a recessed-center rough-grinding flex disk in cross section, with a cork damping layer, and FIG. 6 is an enlarged detail of area VI of FIG. 5.

DETAILED DESCRIPTION OF PREFERRED EMBODIMENT

As it can be seen in FIGS. 1 and 2, a grinding disk 1 consists of a plurality of layers which are placed successively in the hollow mold of the press. First a fabric reinforcement 5 is placed on the annular flange 3 in accordance with both these figures, and on that the abrasive grit layer composed of abrasive grits 6 coated with binding agent 7 is placed by means of a slider. On this layer there is placed the vibration damping material in the form of a powder which, after the pressed disk has been cured, forms the noise-damping layer. An additional fabric reinforcement 5 is laid o the powder layer of vibration damping material, and then a second layer of grinding grits 6 coated with binding agent 7 is applied, and on that, finally, a third fabric reinforcement 5. The sandwich thus formed is pressed to the required thickness and then cured as described.

FIGS. 3 and 4 illustrate the construction of a grinding disk having two noise-damping layers 8 and three fabric reinforcements 5, the fabric reinforcements 5 being provided both on the outside and in the center of the flex disk 1'.

FIGS. 5 and 6 differ from FIGS. 1 and 2 in that here the noise-damping layer 8 continues, even after pressing and curing, to consist of individual particles, namely of cork particles 4 surrounded by synthetic resin 4'. The rest of the construction of this disk 1Δ is identical with that of FIGS. 1 and 2.

The invention will be further explained below with the aid of examples.

EXAMPLE 1

Undamped grinding disk from ordinary series manufacture. Grinding disk dimensions: diameter 178 mm, thickness 8 mm, hole size 22 mm.

Electrocorundum is used as the abrasive grit. The grit size designation corresponds to the Fepa Standard. A mixed grit is used, consisting of 25.9 wt.-% grit 24
25.9 wt.-% grit 30 and
25.9 wt.-% grit 36.

The binder was 3 wt.-% phenol-formaldehyde resol, commercially available under the name Bakelite Resol 433,
11.3 wt.-% phenol-formaldehyde novolak, commercially available as Bakelite Novolak 227,
4 wt.-% pyrite
4 wt.-% cryolite.

300 g of Resol 433 were added to 7,780 g of the corundum mixture and mixed for five minutes in a planetary mixer. The wetted grits were then mixed with 400 g of pyrite and 400 g of cryolite plus 1,120 g of Novolak 227. The agglomerates and clumps were screened out. 300 g of the homogeneous, free-flowing grinding disk mixture thus obtained was uniformly spread out in a press mold, and fabric reinforcements were put in, two on the outside and one on the inside. The mixture was pressed into disks with an outside diameter of 178 mm, a hole diameter of 22 mm, and a disk thickness of 8 mm. The sandwich obtained was stacked with several other sandwiches pressed in the same manner, and cured according to a temperature curve commonly used for phenolic resins, i.e., heating up to 90° C. in four hours, heating up to 120° C. in three hours, hold at 120° C. for five hours, heat up to 180 degrees in three hours, hold at 180° C. for two hours, then cool back to room temperature.

EXAMPLE 2

With the same build-up, i.e., placing the fabric reinforcements outside and in, and the same manufacturing procedure, an electrocorundum of grit size 30 was used as the abrasive, which was jacketed in ceramic, i.e., the surface of the grit is covered partially with silicates to improve adhesion to the binding agent.

75.8 wt.-% electrocorundum, grit 30
3 wt.-% phenol-formaldehyde resol, commercially available under the name, Bakelite Resol 433
13.5 wt.-% phenol-formaldehyde novolak, commercially available under the name, Bakelite Novolak 227
5 wt.-% cryolite
0.7 wt.-% lime.

EXAMPLE 3

Noise-damped grinding disk according to the invention.

The formula for the grinding disk mixture an the method by which the grinding disk is made are the same as in Example 1. The grinding disk consists of three grinding layers, two damping layers and three fabric reinforcements.

270 g of grinding disk mixture was divided into three layers so that 90 g went into each layer. For the noise-damping layer, 40 g of noise-damping material was used, which was divided into two layers of 20 g each. The layers were charged into the mold alternately, the grinding disk mixture being the bottom layer, and a fabric reinforcement was placed on the noise-damping layers. The sandwich pressed to the specified dimensions was cured as in Example 1, and the thickness of the damping layer averaged 1.3 mm after setting. To make the noise-damping layer, 79 wt.-% of a nitrile rubber commercially available under the name Hycar was mixed with 20 wt.-% of an epoxy resin commercially available under the name Araldit, plus 1 wt.-% of magnesium oxide (MgO). For this purpose 790 g of Hycar resin, 200 g of Araldit and 10 g of MgO were mixed for five minutes in a planetary mixer; the MgO additive produced an improvement of the workability of the mixture, i.e., preventing it from sticking and turning lumpy. The powder obtained had an average diameter of 100 microns.

EXAMPLE 4

The formulation and preparation of the noise-damped grinding disk are the same as in Example 3 except for the damping layer. The damping layer consisted of 41.7 wt.-% of cork flour with an average diameter of 250 microns, 16.6 wt.-% of a wetting agent marketed as SZ 449 (Bakelite), and 41.7 wt.-% of epoxy resin marketed as SB 330 (Bakelite). 417 g of cork flour was mixed for five minutes with 166 g of wetting agent SZ 449. The moistened cork flour was then mixed with 417 g of epoxy resin powder SP 330 and stirred for an additional five minutes.

EXAMPLE 5

The formulation of the grit layer is the same as in Example 2. The formulation of the noise-damping layer is the same as in Example 3. Two noise-damping layers were used.

EXAMPLE 6

The formulation of the grit layer and the placement of the fabric reinforcement are the same as in Example 2, but before the middle layer of fabric was laid down, one additional damping layer was put in, whose thickness was 2.5 mm.

EXAMPLE 7

The formulation of the grinding disk mixture is the same as in Example 2, and that of the noise-damping layer the same as Example 3. Unlike Example 3, however, the noise-damping layers were disposed on the outside layers directly in back of the fabric reinforcements, so that they held the grinding disk mixture between them.

EXAMPLE 8

Same as Example 6, but the damping layer material was a mixture of 10 wt.-% epoxy resin and 90 wt.-% nitrile rubber.

EXAMPLE 9

Same as Example 6, but the damping layer material was a mixture of 30 wt.-% epoxy resin and 70 wt.-% nitrile rubber.

The disks made according to the above nine examples were subjected to a grinding test together with a commercial disk in accordance with AT-AS 46 15/82 (Example 10 in Table 2). The tool was a Bosch Model 060 1331 angle disk grinder; the noise level was measured in front of a closed grinding booth at 2 meters distance from the workpiece. The inherent noise of the disk grinder was 67 dBA. The noise measuring instrument was an ELDO 4 instrument made by Rhode and Schwarz, measuring range 16 Hz to 16 KHz using an A filter. A pipe of St 35 with a diameter of 191 mm and a wall thickness of 17 mm was ground, for a period of 10 minutes.

In addition to the noise level (dBA), the Q factor was determined:

$$Q = \frac{\text{Material removed } (g)}{\text{Disk wear } (g)}$$

and the grinding rate:

$$Z = \frac{\text{Material removed } (g)}{\text{Grinding time (min.)}}$$

The following values were obtained.

TABLE 2

| Example | Q factor | Grinding rate | Noise level (dBA) |
|---|---|---|---|
| 1 | 7.8 | 38.7 | 81 |
| 2 | 10.7 | 45.3 | 81 |
| 3 | 3.5 | 42.0 | 67 |
| 4 | 4.2 | 42.0 | 73 |
| 5 | 8.3 | 37.5 | 67 |
| 6 | 8.5 | 40.7 | 70 |
| 7 | 5.8 | 44.3 | 76 |
| 8 | 4.3 | 50.1 | 67 |
| 9 | 10.9 | 37.5 | 76 |
| 10 | 9.8 | 24.6 | 70 |

It will be understood that the specification and examples are illustrative but not limitative of the present invention and that other embodiments within the spirit and scope of the invention will suggest themselves to those skilled in the art.

What is claimed is:

1. A method for producing a laminated grinding disk of the type used for free-hand grinding and formed of layers of abrasive grits and binding agents separated by layers of vibration damping material wherein the method comprises the following steps:

(a) introducing a first layer having a mixture of abrasive grits and binding agents into a press mold;

(b) introducing a second layer of vibration damping material in the form of a free-flowing powder or a granular product into said press mold;

(c) introducing a third layer having a mixture of abrasive grits and binding agents into said press mold;

(d) pressing said first, second and third layers together to form a sandwich and preventing delamination of said layers; and (e) curing said sandwich and forming the laminated grinding disk.

2. The method of claim 1, wherein said step (b) comprises adding a filler material to said powder or granular product and forming a homogeneous mixture of said vibration damping material.

3. The method of claim 2, wherein said homogeneous mixture comprises grains of an average grain size in a range of 50 to 2,000 microns as measured in a standard granulator.

4. The method of claim 3 wherein said filler material of said homogeneous mixture is an inorganic material of the group consisting of magnesium oxide, zinc oxide, talc and marble flour.

5. The method of claim 1, wherein said step (b) further comprises adding an elastomer being able to withstand a thermal stress equal to or greater than 110° C., to said vibration damping material.

6. The method of claim 5, wherein said elastomer is a member of the group consisting of natural rubber, synthetic rubber, butyl rubber, nitrile rubber, neoprene, fluoroelastomer, polyacrylate, polyurethane, silicone rubber, polysulfide rubber and Hypalon.

7. The method of claim 6, wherein said elastomer is nitrile rubber.

8. The method of claim 7, wherein said step (b) further comprises mixing a synthetic resin with said vibration damping material and forming a homogeneous mixture.

9. The method of claim 8, wherein said synthetic resin is a member of the group consisting of epoxy resin, phenolformaldehyde resin, melamine resin, urea resin and polyester resin.

10. The method of claim 9, wherein said synthetic resin is epoxy resin.

11. The method of claim 10, wherein said epoxy resin is mixed with said nitrile rubber in a ratio of epoxy resin to nitrile in the range of 10:90 to 70:30.

12. The method of claim 1, wherein said vibration damping material comprises a mixture of cork particles and synthetic resin.

13. The method of claim 1, wherein said step (a) comprises introducing a fabric reinforcement material into said press mold prior to introducing said first layer of said abrasive grits and binding agents.

14. The method of claim 13, wherein said fabric reinforcement material is introduced onto a convex-shaped flange of said press mold, said flange located substantially in the center of said press mold and forming a corresponding concave shaped form in a center portion of said reinforcement fabric.

15. The method of claim 1, wherein said step (c) comprises introducing a fourth layer of vibration damping material in the form of a free-flowing powder or granular product into said press mold.

16. The method of claim 15, wherein said step (c) further comprises introducing a fifth layer having a mixture of abrasive grits and binding agents into said press mold.

17. The method of claim 16, wherein said step (c) further comprises introducing a sixth layer having a fabric reinforcement material into said press mold prior to said introduction of said fourth layer into said press mold.

18. In an improved laminated grinding disk of the type used for free-hand grinding and formed of layers of abrasive grits and binding agents separated by layers of vibration damping material the improvement comprising:

(a) forming the disk by introducing a first layer having a mixture of the abrasive grits and the binding agents into a press mold;

(b) introducing a second layer of vibration damping material in the form of one of a free-flowing powder and granular product onto said first layer in said press mold; and (c) introducing a third layer having a mixture of the abrasive grits and the binding agents onto said second layer of said vibration damping material in said press mold, said third layer being pressed together with said firs and second layers and forming a sandwich, said sandwich cured into the laminated grinding disk and delamination of said first, second and third layers being prevented.

19. The laminated disk of claim 18 further comprising a reinforcement fabric material introduced into said press mold prior to the introduction of said first layer.

20. The laminated disk of claim 18 further comprising a fourth layer of vibration damping material in the form of a free-flowing powder or granular product introduced onto said third layer of abrasive grits and binding agents in said press mold; a fifth layer having a mixture of abrasive grits and binding agents introduced onto said fourth layer in said press mold; and a second reinforcement fabric material introduced into said press mold after said introduction of said fourth layer.

21. The laminated disk of claim 18, wherein said step (b) comprises adding a filler material to said powder or granular product and forming a homogeneous mixture of said vibration damping material.

22. The laminated disk of claim 21, wherein said homogeneous mixture comprises grains of an average grain size in a range of 50 to 2,000 microns as measured in the standard granulator.

23. The laminated disk of claim 18, wherein said step (b) further comprises adding an elastomer being able to withstand a thermal stress equal to or greater than 110° C., to said vibration damping material.

24. The laminated disk of claim 23, wherein said elastomer is a member of the group consisting of natural rubber, synthetic rubber, butyl rubber, nitrile rubber, neoprene, fluoroelastomer, polyacrylate, polyurethane, silicone rubber, polysulfide rubber and Hypalon.

25. The laminated disk of claim 24, wherein said elastomer is nitrile rubber.

26. The laminated disk of claim 25, wherein said step (b) further comprises mixing a synthetic resin with said vibration damping material and forming a homogeneous mixture.

27. The laminated disk of claim 26, wherein said synthetic resin is a member of the group consisting of epoxy resin, phenolformaldehyde resin, melamine resin, urea resin and polyester resin.

28. The laminated disk of claim 27, wherein said synthetic resin is epoxy resin.

29. The laminated disk of claim 28, wherein said epoxy resin is mixed with said nitrile rubber in a ratio of epoxy resin to nitrile in the range of 10:90 to 70:30.

30. The laminated disk of claim 18, wherein said step (c) comprises introducing a fourth layer of vibration damping material in the form of a free-flowing powder or granular product into said press mold.

31. The laminated disk of claim 30, wherein said step (c) further comprises introducing a fifth layer having a mixture of abrasive grits and binding agents into said press mold.

32. The laminated disk of claim 31, wherein said step (c) further comprises introducing a sixth layer having a fabric reinforcement material into said press mold prior to said introduction of said fourth layer into said press mold.

* * * * *

UNITED STATES PATENT AND TRADEMARK OFFICE

CERTIFICATE OF CORRECTION

PATENT NO. : 5,092,082

DATED : March 3, 1992

INVENTOR(S) : Hans J. Padberg et al

It is certified that error appears in the above-identified patent and that said Letters Patent is hereby corrected as shown below:

Column 4, line 61, "o" should read --on--.

Column 5, line 8, delete "Δ" and insert --"--.

Column 6, line 1, "an" should read --and--.

Column 9, line 9, "firs" should read --first--.

Signed and Sealed this

Sixth Day of July, 1993

Michael K. Kirk

*Attest:*

MICHAEL K. KIRK

*Attesting Officer*

*Acting Commissioner of Patents and Trademarks*